United States Patent [19]

Chaney

[11] Patent Number: 4,908,971

[45] Date of Patent: Mar. 20, 1990

[54] SAFETY LOCK FOR FIREARMS

[76] Inventor: James C. Chaney, 9681 Pinecone Dr., Cantonment, Fla. 32533

[21] Appl. No.: 360,531

[22] Filed: Jun. 2, 1989

[51] Int. Cl.[4] ..... F41C 17/00; F41C 27/08

[52] U.S. Cl. ..... 42/70.11; 42/96

[58] Field of Search ..... 42/70.11, 96

[56] References Cited

U.S. PATENT DOCUMENTS

| | | | |
|---|---|---|---|
| 2,479,107 | 8/1949 | Garretson | 42/70.11 |
| 2,836,918 | 6/1958 | Pula et al. | 42/70.11 |
| 3,444,639 | 5/1969 | Rockwood | 42/70.11 |
| 3,849,923 | 11/1974 | Hawkins | 42/96 |
| 4,084,340 | 4/1978 | Scudder | 42/96 |
| 4,398,366 | 8/1983 | Wernicki | 42/70.11 |
| 4,512,099 | 4/1985 | Mathew | 42/70.11 |
| 4,783,924 | 11/1988 | Thurber | 42/70.11 |

FOREIGN PATENT DOCUMENTS

| | | | |
|---|---|---|---|
| 2082293 | 3/1982 | United Kingdom | 42/70.11 |

*Primary Examiner*—Deborah L. Kyle
*Assistant Examiner*—Michael J. Carone
*Attorney, Agent, or Firm*—Fleit, Jacobson, Cohn, Price, Holman & Stern

[57] ABSTRACT

A plug is inserted into and withdrawn from the muzzle end of a gun barrel by means of an external grip to store the gun in a safe condition with a dummy cartridge in its firing chamber. A retainer formation within the dummy cartridge is engageable by an elastically deformable lock device fixed to the inner end of the plug so that the plug may be respectively locked to and released from the dummy cartridge by opposite insertion and extraction forces of different lock engaging and lock releasing magnitudes to prevent loading and unintended firing of the firearm.

16 Claims, 1 Drawing Sheet

SAFETY LOCK FOR FIREARMS

BACKGROUND OF THE INVENTION

This invention relates to the storing of firearms in a safe condition in which accidental discharge thereof is prevented.

The provision of means for preventing unintentional discharge of firearms, including revolvers and shot guns, is generally well known in the art as disclosed and referred to in U.S. Pat. No. 4,783,924 to Thurber, by way of example. Generally, the storage of firearms in a safe condition preventing accidental discharge as referred to in the Thurber patent, involves the disposition of a dummy cartridge within the firing chamber of the firearm and insertion of a rod through the gun barrel from the muzzle end into locking engagement with such cartridge. Release of locking engagement between the inserted rod and the dummy cartridge involves a procedure or the use of a force of such magnitude with which children are unable to cope, to thereby discourage loading and unintended firing of the firearm. Such prior art safety devices for firearms are relatively complex, expensive and limited in use by reason of dimensional restrictions and associated operating procedures involving, for example, the use of coil springs, cables, locking balls and separate rod insertable instruments. A rather complex locking mechanism is associated, for example, with the hand gun safety device disclosed in the aforementioned Thurber patent, wherein locking engagement is effected by applying an inward push on the inserted rod while unlocking of the mechanism is effected by a second inward push applied in the same direction to the inserted rod.

It is therefore an important object of the present invention to provide safety apparatus for firearms which is more economical, less complex and thereby more reliable and more versatile as compared to prior art arrangements.

SUMMARY OF THE INVENTION

In accordance with the present invention, a dummy cartridge disposed within the firing chamber of a firearm is releasably locked to a slide fit plug inserted into the bore of the barrel of the firearm from its muzzle end by means of an external grip knob having a cap portion abutting the muzzle end of the barrel when the plug is fully inserted. The inserted plug is locked to the dummy cartridge by means of an elastically deformable, camming type lock device engageable with mating surfaces of a retainer formation within the dummy cartridge at an end portion thereof into which the lock device is inserted by an insertion force applied to the plug through the grip knob. During locking engagement, the lock device undergoes elastic deformation under the insertion force. The lock device is releasable by an extraction force applied thereto in the opposite direction, of a magnitude greater than the insertion force so as to prevent unintended unlocking and removal, by children for example. The extraction force is applied externally by a pull on the grip knob.

According to certain embodiments of the invention applicable to firearms in general, the plug is rigidly interconnected with the elastically deformable lock device by means of a elongated barrel rod extending through the bore of the barrel with radial clearance. A cavity may be formed within the dummy cartridge extending from the end portion thereof at which the retainer formation is located in order to hold a vapor phase inhibiter therein to prevent surface deterioration of the barrel bore during storage. In order to maintain the vapor phase inhibiter effective, the barrel bore as well as the firing chamber is sealed by 0-ring seals respectively carried by the plug adjacent the muzzle end of the bore and the dummy cartridge adjacent an extraction end. In the case of a revolver, the end of the dummy cartridge is rimmed while in the case of a "break-open" shotgun, it is rimless. A semi-rimmed dummy cartridge is used for pistols, rifles, pump and semi-automatic shotguns.

In regard to the elastically deformable lock device aforementioned, it includes angulated camming surfaces engageable with mating surfaces of the retainer formation in the dummy cartridge arranged to effect locking engagement in response to an insertion force of a magnitude lower than the lock releasing extraction force in the opposite axial direction relative to the barrel bore. The minimum magnitude for such lock releasing extraction force, is sufficiently high to exceed the capability of children.

In accordance with certain embodiments of the invention, the elongated rod interconnecting the plug with the elastically deformable lock device at its inner end is axially adjustable to accommodate gun barrels of different lengths, it being appreciated that the plug and the dummy cartridge are respectively dimensioned to form sliding fits with the gun barrel at its muzzle end and the firing chamber in all embodiments of the invention.

In accordance with some embodiments of the invention, the elastically deformable lock device is connected directly to the inner end of the plug insertable into the barrel bore at its muzzle end. The dummy cartridge in such case is provided with its retainer formation at its extraction end. In such case, the dummy cartridge is rimless and can only be removed by use of the lock device after the plug is removed by means of the grip knob attached to its outer end. The lock device extending from the inner end of the plug is so utilized as a muzzle key insertable into the extractor end of the dummy cartridge. Thus, withdrawal of the dummy plug from a "break open" shot gun aforementioned is made possible by exerting an axial extraction force on the inserted muzzle key through the grip knob, of a value less than the lock releasing extraction force.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

Figure 3:
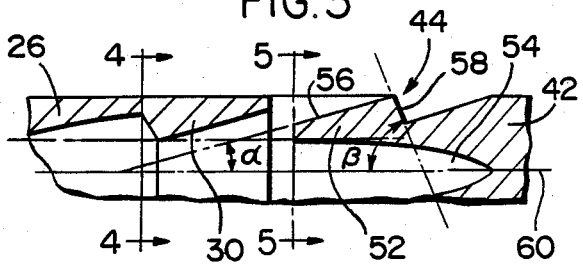
FIG. 3 is a partial side section view of the lock and retainer formation associated with the apparatus shown in FIGS. 1 and 2 in relative positions prior to engagement.
Figure 4:
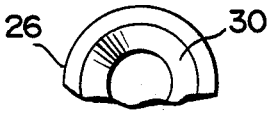
Figure 5:
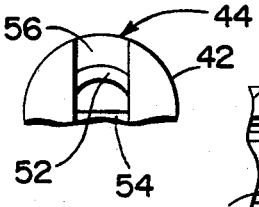

FIGS. 4 and 5 are transverse section views taken substantially through planes indicated by section lines 4—4 and 5—5 in FIG. 3.

Figure 6:
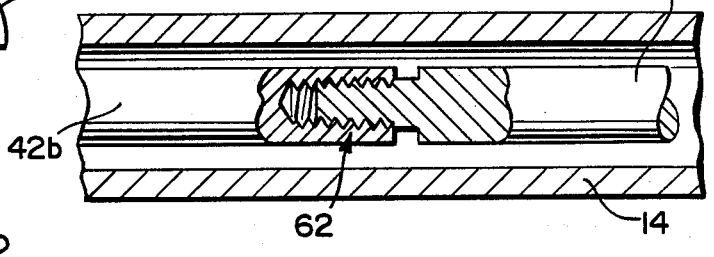
Figure 2:
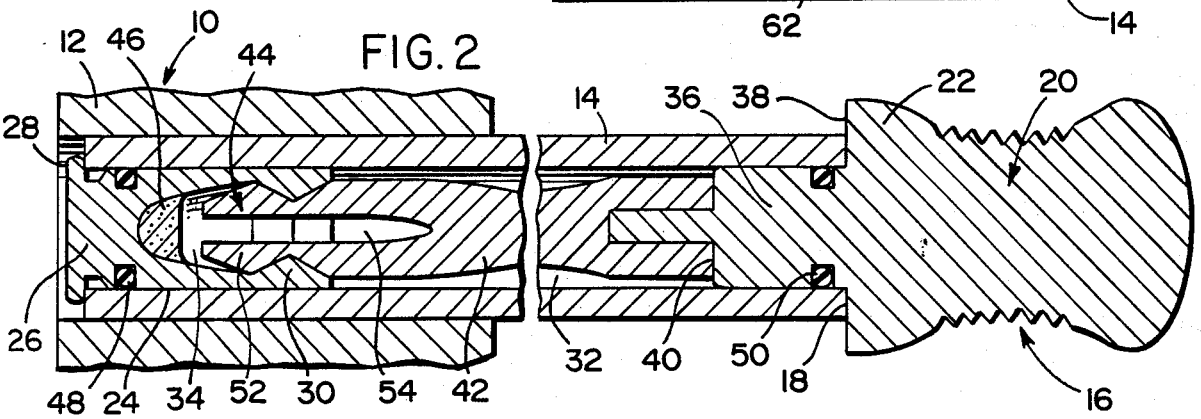
FIG. 2 is an enlarged partial section view taken substantially through a plane indicated by section line 2—2 in FIG. 1.

FIG. 6 is a partial side section view showing a modification of the safety apparatus shown in FIG. 2.

Figure 7:
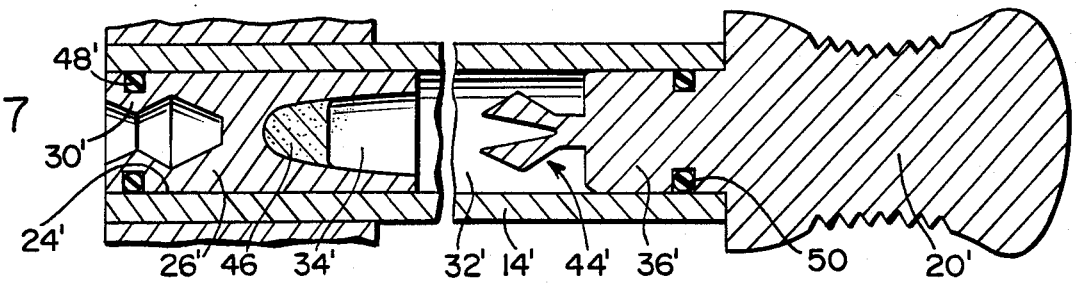

FIG. 7 is a partial side section view similar to that of FIG. 2, showing a shotgun safety apparatus in accordance with another embodiment of the present invention.

DETAILED DESCRIPTION OF PREFERRED EMBODIMENTS

Figure 1:
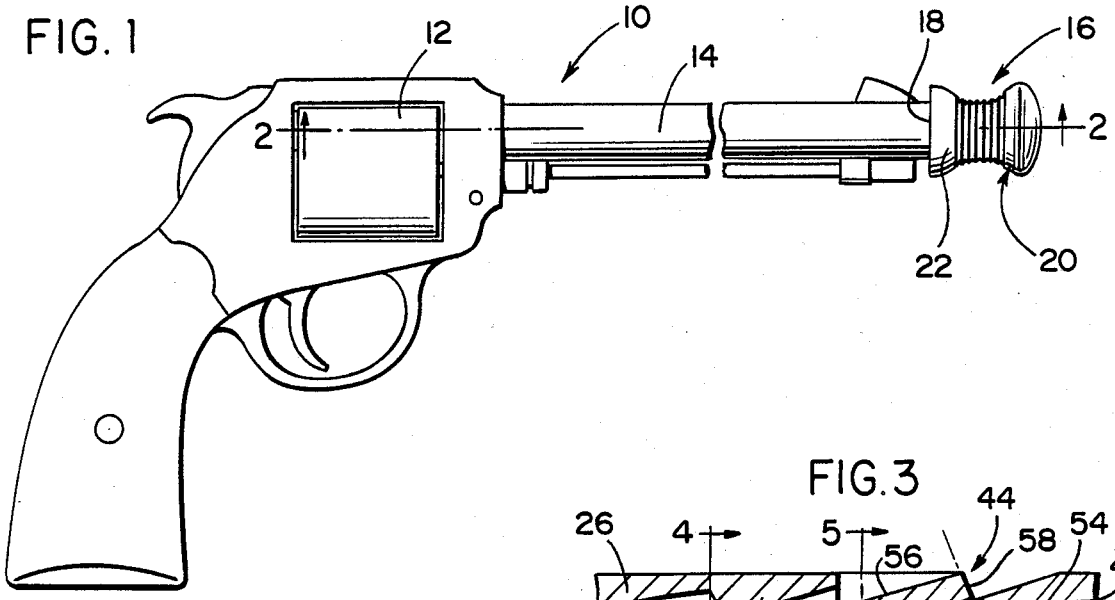
FIG. 1 is a side elevational view of a revolver type of hand gun firearm with the safety apparatus of the present invention in accordance with one embodiment installed therein.

Referring now to the drawing in detail, FIG. 1 illustrates a hand gun type of firearm in the form of a revolver generally referred to by reference numeral 10 having a gun cylinder 12 within which firing chambers are located for receiving cartridges to be aligned with the bore in a gun barrel 14. Safety apparatus generally referred to by reference numeral 16 is inserted into the firearm through the muzzle end 18 of the gun barrel, the apparatus 16 including a grip knob 20 having a cap portion 22 abutting the muzzle end 18, as shown in FIG. 1, when the apparatus is fully inserted into the firearm.

As shown in FIG. 2, the gun cylinder 12 encloses a firing chamber 24 within which a dummy cartridge 26 associated with apparatus 16 is disposed. The dummy cartridge is externally dimensioned to be received within the firing chamber with a close sliding fit and is provided at one axial end with a semi-rimless extraction flange 28. In the embodiment illustrated in FIG. 2, the dummy cartridge 26 has an end portion opposite the extraction flange 28 provided with an inwardly projecting annular retainer formation 30. The end portion of the dummy cartridge at which the retainer formation 30 is located, forms an opening for communication between the bore 32 of the gun barrel 14 and a storage cavity 34 within the dummy cartridge.

With continued reference to FIG. 2, the grip knob 20 is connected to the outer axial end of a plug 36 externally dimensioned to form a close sliding fit with the bore 32 of the barrel 14 into which the plug is inserted from the muzzle end 18. When the plug is fully inserted, the annular stop surface 38 of the grip cap portion 22, abuts the muzzle end 18 as shown. The inner axial end 40 of the plug 36 is connected as by welding to one end of an elongated rod 42 which extends with radial clearance through the barrel bore into the firing chamber 24. The inner end of the rod 42 is provided with a locking device generally referred to by reference numeral 44 engageable with the retainer formation 30 aforementioned within the dummy cartridge 26 as shown in FIG. 2.

According to certain embodiments of the invention, a vapor phase inhibiter 46 is disposed within the cavity 34 of the dummy cartridge 26. In order to maintain such inhibiter effective, the firing chamber and bore of the barrel are sealed by 0-ring seal elements 48 and 50 respectively carried on the dummy cartridge adjacent the extraction flange 28 and on the plug 36 adjacent its outer end in sealing contact with the bore of the barrel adjacent the muzzle end 18.

Referring now to FIGS. 2–5, the lock device 44 is formed at the inner end of the rod 42 by of a pair of elastically deformable arms 52 projecting from the cylindrical end of the rod 42 spaced apart by the gap 54. The radially outer portion of each elastically deformable arm 52 is provided with a camming surface 56 extending at a forward facing angle $\alpha$ to the geometrical axis of the rod 42 with which the locking device is associated, as more clearly seen in FIG. 3. Such camming surface 56 is angled forwardly from a rearwardly facing camming surface 58 at a rearwardly facing angle $\beta$ to the axis 60 of the rod, as also shown in FIG. 3. The angle $\beta$ is greater than the angle $\alpha$ as shown. As also shown in FIG. 3, the camming surfaces 56 and 58 of the locking device 44 are generally parallel to mating surfaces on the retainer formation 30 with which the locking device is shown in aligned in spaced relationship. Accordingly, locking engagement of the lock device 44 with the retainer formation 30 occurs in response to an axial insertion force transmitted to the locking device through the rod 42, causing elastic inward deflection of the arms 52 of the lock device before locking engagement is achieved when the lock device is fully inserted into the cavity 34 of the dummy cartridge 26 as shown in FIG. 2. The magnitude of the insertion force necessary to elastically deflect the locking arms 52 in order to effect locking engagement with the retainer formation 30 will depend upon the acute angle $\alpha$ of surface 56 as aforementioned in connection with FIG. 3. Release of the locking device by a lock releasing extraction force in the opposite direction, on the other hand, will depend upon the acute angle $\beta$ of the camming surface 58, such extraction force being greater than the insertion force because of the correspondingly larger angle $\beta$ associated therewith. Accordingly, the locking device 44 may be designed to require a predetermined lock releasing extraction force magnitude, exceeding the capability of children, dependent upon the elasticity of the material and the angle $\beta$. Such effective lock releasing extraction force will be greater than the effective lock engaging insertion force.

FIG. 6 illustrates a modification through which the elongated rod 42 is made adjustable in length in order to accommodate gun barrels 14 of different lengths. Thus, the elongated rod 42 is formed in two sections 42A and 42B, as shown in FIG. 6, interconnected by adjustable threaded means 62.

FIG. 7 illustrates safety apparatus embodying the principles of the invention as hereinbefore described with respect to FIGS. 1–5, applicable however to the gun barrel 14' of a "break-open" type of shotgun or a firearm barrel being stored as a spare part and having a firing chamber 24' within which a dummy cartridge 26' is disposed. In the embodiment illustrated in FIG. 7, the dummy cartridge 26' has no extraction flange at its outer end (rimless). Instead, the extraction end of the dummy cartridge which may be exposed by a "break-open" operation of a shotgun type of firearm, is provided with an inwardly projecting, annular retainer formation 30' similar in structure and function to the retainer formation 30 aforementioned in connection with the embodiment illustrated in FIG. 2. The other inner end of the dummy cartridge 26' is provided with the storage cavity 34' in communication with the bore 32' of the barrel 14'. A vapor phase inhibiter 46 may be stored within the cavity 34' as shown in FIG. 7 for exposure to the barrel bore as in the case of the previously described embodiment of FIG. 2. However, no elongated rod is provided to lock the dummy cartridge 26' in place within the firing chamber, inasmuch as it is not provided with any extraction flange for withdrawal from the firing chamber. In order to extract the dummy cartridge 26' from its firing chamber 24' and seal the barrel bore to which the inhibiter 46 is exposed, the safety device of the embodiment illustrated in FIG. 7 includes a plug 36' having its outer end connected to a grip knob 20', the plug 36' and grip knob 20' being similar in construction and function to the plug 36 and knob 20 hereinbefore described in connection with FIG. 2. The dummy cartridge 26' and plug 36' are also provided with 0-ring seals 48' and 50' in order to seal the firing chamber 24' and barrel bore 34' in order to maintain the inhibiter 46 effective during storage of the gun. The embodiment of FIG. 7 differs somewhat from the embodiment of FIG. 2 in that the lock device 44' is connected directly to the inner end of the plug 36' and is axially spaced from the dummy cartridge 26' while the plug is seated within the muzzle end of the barrel.

The lock device 44' is similar in structure and function to the lock device 44 hereinbefore described in connection with FIGS. 1–5 except that it is utilized somewhat differently in view of the different location for the retainer formation 30' in the dummy cartridge 26' and the lack of any extraction flange for the dummy cartridge 26', as aforementioned. Thus, the plug 36' and the lock device 44' are withdrawn from the muzzle end of the barrel when the shot gun is to be utilized. The lock device 44' may then be inserted as a muzzle key by means of the grip knob 20 into the extraction end of the dummy cartridge 26' for locking engagement with the retainer formation 30' as hereinbefore described in connection of locking engagement with the retainer formation 30 in the embodiment of FIGS. 1–5. Also, the effective extraction force for releasing locking engagement between the lock device 44' and the retainer formation 30' is greater than the effective lock engaging insertion force so that the dummy cartridge 26' may be withdrawn by an extraction force of a magnitude greater than said lock engaging insertion force but less than the predetermined lock releasing force in order to enable extraction or withdrawal of the dummy cartridge from its firing chamber. Once the dummy cartridge 26' is withdrawn, it may be separated from the lock device 40' by an extraction force in excess of the predetermined effective lock releasing force as aforementioned.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, said cartridge including an end portion within which the locking means is received and a retainer formation within said end portion engageable by the locking means, said locking means including an elastically deformable element insertable into the end portion of the cartridge and camming surface means on the deformable element engageable with the retainer formation for effecting said locking and releasing of the plug, respectively, in response to the insertion and extraction forces of the different lock engaging and lock releasing magnitudes.

2. The device as defined in claim 1 wherein the lock releasing magnitude of the extraction force is greater than the lock engaging magnitude of the insertion force.

3. The device as defined in claim 2 further including an elongated rod connecting the inner end of the plug to the elastically deformable element.

4. The device as defined in claim 3 where the cartridge further includes a storage cavity, a vapor phase inhibiter within the storage cavity and means mounted on the cartridge and the plug for sealing the firing chamber and the bore of the barrel to maintain the inhibiter effective.

5. The device as defined in claim 2 wherein the cartridge further includes a storage cavity, a vapor phase inhibiter within the storage cavity and means mounted on the cartridge and the plug for sealing the firing chamber and the bore of the barrel to maintain the inhibiter effective.

6. The device as defined in claim 5 wherein the cartridge has an inner axial end opposite said end portion within which the locking means is received, the storage cavity being in communication with the bore of the barrel through said inner axial end and the sealing means being mounted on the end portion of the cartridge within which the retainer formation is located.

7. Apparatus for preventing discharge of a firearm barrel having a bore extending to a muzzle end and in communication with a firing chamber, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber, an elongated rod connected to the inner end of the plug and extending through the bore of the barrel into the firing chamber and locking means carried by the rod for locking and releasing the cartridge in response to said insertion and extraction forces, respectively, transmitted through the rod from the plug in said opposite directions, said cartridge including an end portion within which the locking means is received and a retainer formation within said end portion engageable by the locking means, said locking means including elastically deformable camming means insertable into said end portion of the cartridge to engage the retainer formation for effecting said releasing of the cartridge when the extraction force exceeds the insertion force by a predetermined amount.

8. In combination with a firearm barrel in communication with a firing chamber, a plug insertable into the barrel, grip means coupled to the plug for insertion and extraction thereof relative to the barrel in response to directionally opposite forces externally applied, a cartridge disposed within the firing chamber having a retainer formation therein and elastically deformable means engageable with said retainer formation in response to said insertion of the plug by one of said externally applied forces exceeding a lock engaging magnitude for releasably locking the plug to the cartridge, said elastically deformable means including camming surface means for preventing said extraction of the plug from the cartridge by the other of the externally applied forces less than a lock releasing magnitude greater than said lock engaging magnitude.

9. The combination of claim 8 wherein the cartridge includes a storage cavity, a vapor phase inhibiter within the storage cavity and means mounted on the cartridge and the plug for sealing the firing chamber and the barrel to maintain the inhibiter effective.

10. The combination of claim 8 including an elongated rod rigidly interconnecting the elastically deformable means and the plug.

11. The combination of claim 8 wherein the cartridge includes an outer end portion within which the retainer formation is located, said cartridge being withdrawn from the firing chamber by said other of the externally applied forces transmitted by the plug from the grip means.

12. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, said locking means being released from the cartridge by the extraction force of a lock releasing magnitude greater than that of the insertion force necessary to effect said locking of the plug to the cartridge.

13. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, the cartridge including a storage cavity, a vapor phase inhibiter within the storage cavity and means mounted on the cartridge and the plug for sealing the firing chamber and the bore of the barrel to maintain the inhibiter effective.

14. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, said locking means including elastically deformable camming means engageable with the cartridge for effecting said releasing of the cartridge when the extraction force exceeds the insertion force by a predetermined amount.

15. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, said locking means including elastically deformable camming means for withdrawing the cartridge from the firing chamber.

16. Apparatus for preventing discharge of a firearm which includes a barrel having a bore extending to a muzzle end and a firing chamber in communication with the bore of the barrel, said apparatus comprising:

a plug insertable into the bore of the barrel through said muzzle end thereof, said plug having inner and outer ends, grip means coupled to the plug for axial displacement thereof in opposite directions relative to the barrel in response to insertion and extraction forces applied, said grip means including a cap portion coupled to the outer end of the plug and engageable with said muzzle end of the barrel, a dummy cartridge disposed in the firing chamber and locking means rigidly coupled to the inner end of the plug for respectively locking and releasing the plug to and from the cartridge in response to said axial displacement of the plug in said opposite directions, said locking means including an elastically deformable element insertable into an end portion of the cartridge and camming surface means on the deformable element engageable with a retainer formation within said end portion for effecting said locking and releasing of the plug, respectively, in response to the insertion and extraction forces of different lock, engaging and lock releasing magnitudes.

* * * * *